US009247797B2

(12) United States Patent
Cho

(10) Patent No.: US 9,247,797 B2
(45) Date of Patent: Feb. 2, 2016

(54) PERMANENT ROD

(71) Applicant: Myeong-Ja Cho, Gyeonggi-do (KR)

(72) Inventor: Myeong-Ja Cho, Gyeonggi-do (KR)

( * ) Notice: Subject to any disclaimer, the term of this patent is extended or adjusted under 35 U.S.C. 154(b) by 53 days.

(21) Appl. No.: 14/235,956

(22) PCT Filed: Nov. 22, 2012

(86) PCT No.: PCT/KR2012/009908
§ 371 (c)(1),
(2) Date: Jan. 29, 2014

(87) PCT Pub. No.: WO2013/105729
PCT Pub. Date: Jul. 18, 2013

(65) Prior Publication Data

US 2014/0311519 A1 Oct. 23, 2014

(30) Foreign Application Priority Data

Jan. 12, 2012 (KR) ..... 10-2012-0003799

(51) Int. Cl.

| | |
|---|---|
| ***A45D 2/26*** | (2006.01) |
| ***A45D 2/12*** | (2006.01) |
| ***A45D 2/24*** | (2006.01) |
| *A45D 2/10* | (2006.01) |
| *A45D 2/28* | (2006.01) |

(52) U.S. Cl.
CPC *A45D 2/122* (2013.01); *A45D 2/24* (2013.01); *A45D 2/10* (2013.01); *A45D 2/26* (2013.01); *A45D 2/28* (2013.01)

(58) Field of Classification Search
CPC ..... A45D 2/145; A45D 2/10; A45D 2/24; A45D 2/122; A45D 2/362; A45D 2/28; A45D 4/00; A45D 6/00; A45D 6/14; A45D 6/02
USPC ..... 132/280, 245, 246, 253
See application file for complete search history.

(56) References Cited

U.S. PATENT DOCUMENTS

| | | | | | |
|---|---|---|---|---|---|
| 2,962,031 | A | * | 11/1960 | Bumgarner | 132/245 |
| 3,122,146 | A | * | 2/1964 | Safianoff | 132/245 |
| 3,200,824 | A | * | 8/1965 | Coloccia | 132/254 |
| D329,303 | S | * | 9/1992 | Asakura | D28/37 |
| 5,901,711 | A | * | 5/1999 | Jeremy | 132/226 |
| 2004/0069315 | A1 | * | 4/2004 | Kelsey | 132/268 |
| 2009/0255549 | A1 | * | 10/2009 | Smith | 132/245 |

FOREIGN PATENT DOCUMENTS

| | | | |
|---|---|---|---|
| KR | 20-0378780 | A | 3/2005 |
| KR | 10-0881348 | B1 | 2/2009 |
| KR | 10-2010-0106186 | A | 10/2010 |
| KR | 10-2011-0015872 | A | 2/2011 |

* cited by examiner

*Primary Examiner* — Robyn Doan
(74) *Attorney, Agent, or Firm* — AKC Patents, LLC; Aliki K. Collins

(57) ABSTRACT

The present invention relates to a permanent rod. The permanent rod includes a tube-shaped rod body. In the rod body, a pair of cut surfaces is provided to form a band-shaped insertion opening over the entire longitudinal section of the rod body, and a plurality of compression grooves each having a concave bottom surface are formed in the outer surface of the rod body over the entire longitudinal section. Also, the permanent rod includes: a compression member body having a compression surface corresponding to each of the grooved bottom surfaces; and a compression member detachably coupled to the rod body so that the compression surface contacts the grooved bottom surface. Therefore, the permanent rod may create various wave styles.

8 Claims, 10 Drawing Sheets

PERMANENT ROD

CROSS-REFERENCE TO RELATED APPLICATION

This application claims the benefit of Korean Patent Application No. 10-2012-0003799, filed on Jan. 12, 2012 in the Korean Intellectual Property Office, the disclosure of which is incorporated herein by reference.

TECHNICAL FIELD

The present invention relates to a permanent rod, and more particularly, to a permanent rod which is used in making permanent waves in the hair.

BACKGROUND ART

In general, a hair style is an important factor in the cosmetic treatment of a woman, and is set variously depending on dresses, times and places.

As a method of setting the hair style, a method of making waves in the hair is widely used. For this purpose, permanent rods were devised and are used.

FIG. 9 is an exploded perspective view of a permanent rod of the related art.

As shown in FIG. 9, the permanent rod of the related art includes a tubular rod body part 111 having a circular cross-section and an auxiliary rod member 120 which engages with the rod body part 111.

The rod body part 111 has a member fitting recess 111*b* having an arc-shaped cross-section that is greater than 180°. The member fitting recess 111*b* extends along the length of the rod body part 111.

The auxiliary rod member 120 has the shape of a hollow cylinder.

The rod body part 111 and the auxiliary rod member 120 respectively have injection-holes 111*a* and 120*a*.

With reference to FIG. 10, a description will be given below of a method of making waves in the hair using the permanent rod of the related art having this configuration.

First, the distal portion of the hair is wound around the auxiliary rod member 120.

Afterwards, the auxiliary rod member 120 with the hair wound thereon is forcibly fitted into the member fitting recess 111*b*.

After that, a length of the remaining portion of the hair that is desired to be waved is wound on the rod body part 111.

Afterwards, a neutralizer is injected through the injection-holes 111*a* and 120*a* when about 30 to 40 minutes have elapsed after the hair was wound on the rod body part 111.

After that, when about 10 to 20 minutes have elapsed after the neutralizer was injected, the hair is unwound from the rod body part 111 and the auxiliary rod member 120.

Finally, the hair unwound from the rod body part 111 and the auxiliary rod member 120 is washed.

The related-art permanent rod having the above-mentioned configuration was disclosed in Korean Utility Model Application No. 20-1993-0001104 (titled "ROLL TO BE USED STRAIGHT PERMANENT WAVE").

However, according to the permanent rod of the related art, the rod body part 111 does not have any structure that can make any other waves except for the method of winding the hair thereon. It was impossible to make various waves, which is problematic.

DISCLOSURE

Technical Problem

Therefore, an aspect of the present invention is to provide a permanent rod with which various waves can be made.

Technical Solution

The object is realized by a permanent rod that includes a tubular rod body part and pressing members. The rod body part has a pair of cut surfaces which extend along an entire length of the rod body part so as to form a band-shaped insertion opening and a plurality of pressing recesses which extends along the entire length of the rod body part. Each of the pressing recesses has a concave recess bottom surface. Each of the pressing members has pressing member body part which has a pressing surface corresponding to the recess bottom surface. The pressing members are detachably coupled to the rod body part such that the pressing surface adjoins to the recess bottom surface.

It is preferred that the pair of cut surfaces have a concave-convex shape that allows the cut surfaces to engage with each other when the cut surfaces are adjoined to each other such that the rod body part is not warped when the hair is being wound on the rod body part.

In addition, it is preferred that each of the pressing recesses be formed so as to have a V-shaped recess bottom surface such that the movement of the hair that is brought into close contact with the pressing recesses by the pressing members can be reduced.

Furthermore, it is preferred that the rod body part have a ring-seating groove on an outer surface, the ring-seating groove extending in a longitudinal direction of the rod body part, such that the permanent rod according to the present invention can be used without the step of inserting the auxiliary rod into the rod body part.

In addition, it is preferred that each of the pressing members be tube-shaped and have injection-holes in an area that adjoins to the recess bottom surface such that waves formed by the pressing members can be reliably maintained.

Advantageous Effects

According to the present invention, it is possible to make various waves by forming waves using the pressing recesses formed on the rod body part and the pressing members which are coupled to the rod body part so as to be in close contact with the pressing recesses.

Figure 1:
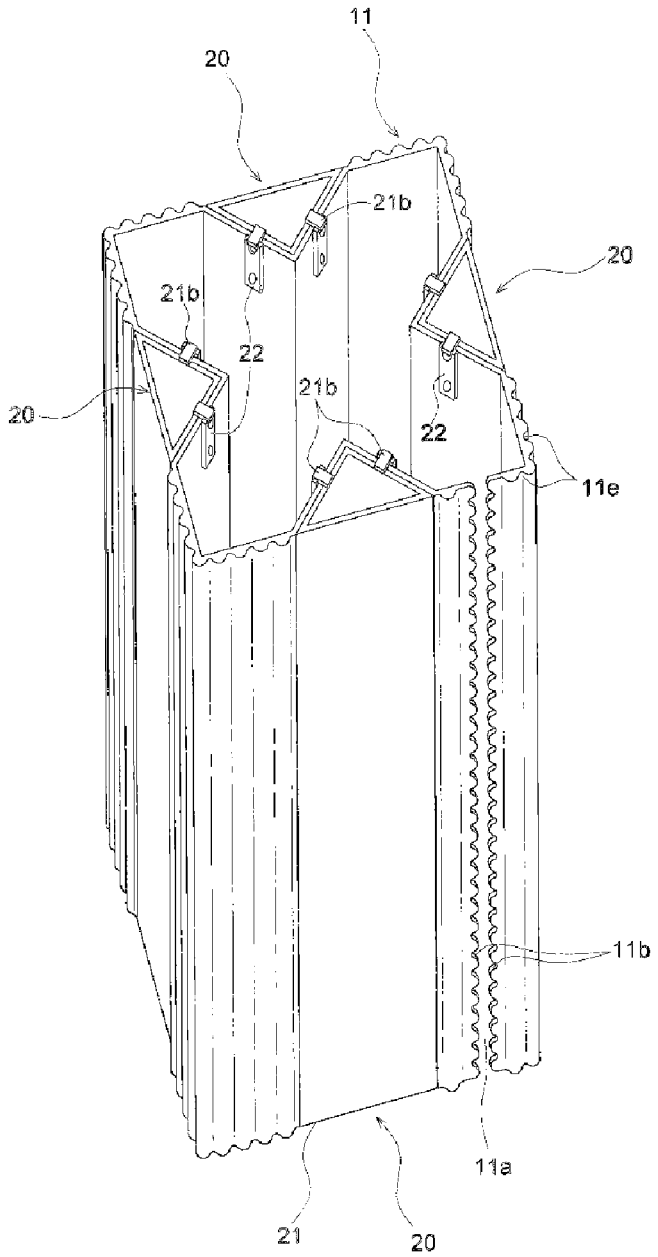
FIG. 1 is an assembled perspective view showing a permanent rod according to an embodiment of the present invention.

| Description of the Reference Numerals in the Drawings | |
|---|---|
| 11, 111: rod body part | 20: pressing member |
| 21: pressing member body part | 22: fixing lever |
| 120: auxiliary rod member | 201: auxiliary rod |

Best Mode

The present invention will be described in detail hereinafter with reference to the accompanying drawings.

Figure 2:
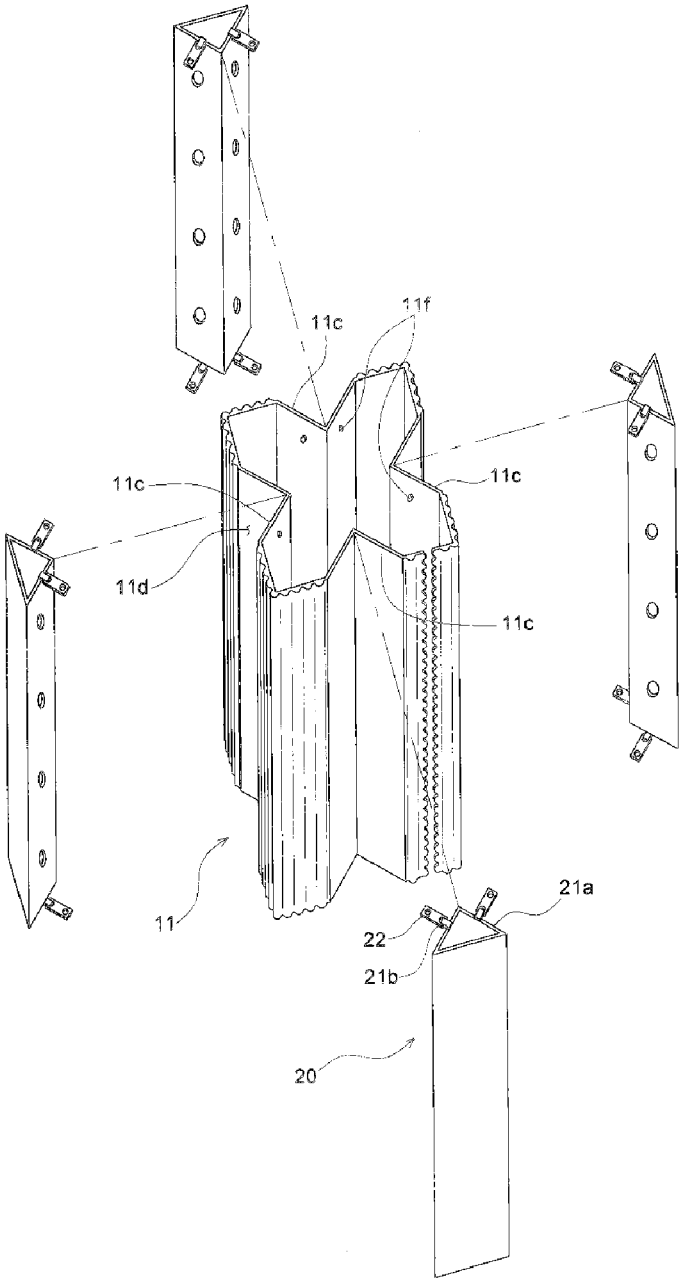
FIG. 2 is an exploded perspective view showing the permanent rod according to one embodiment of the present invention.
Figure 3:
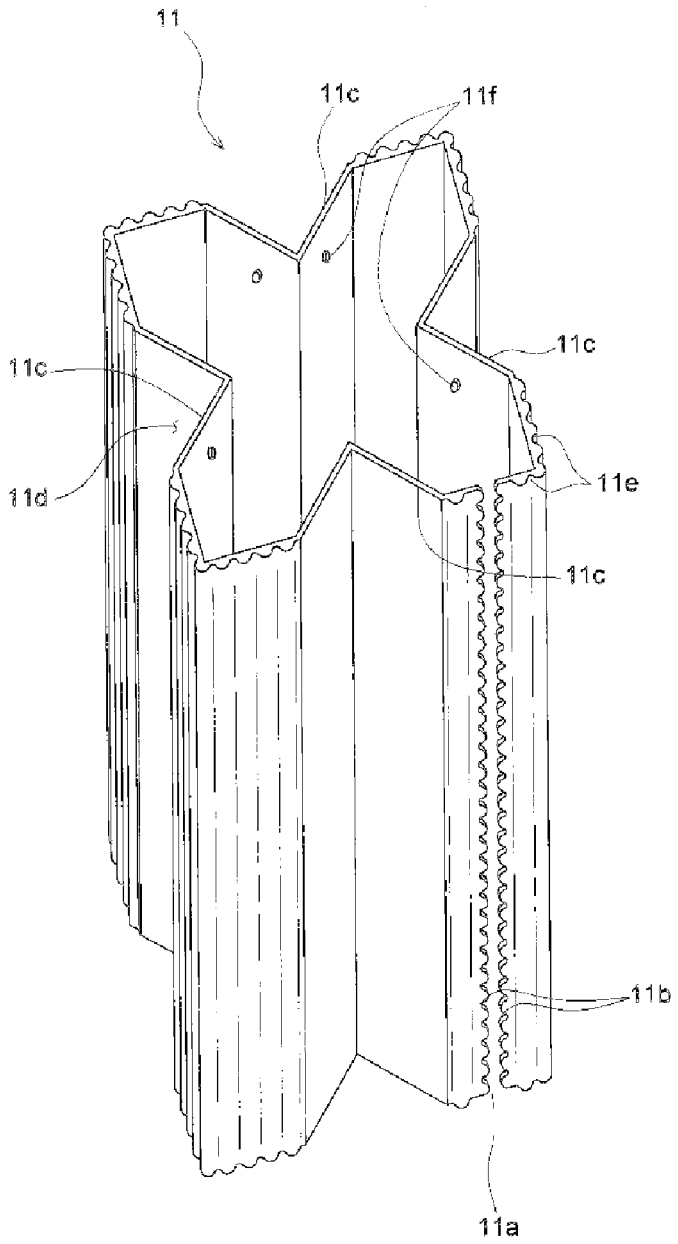
FIG. 3 is a detailed view showing the rod body part of the permanent rod according to one embodiment of the present invention.
Figure 4:
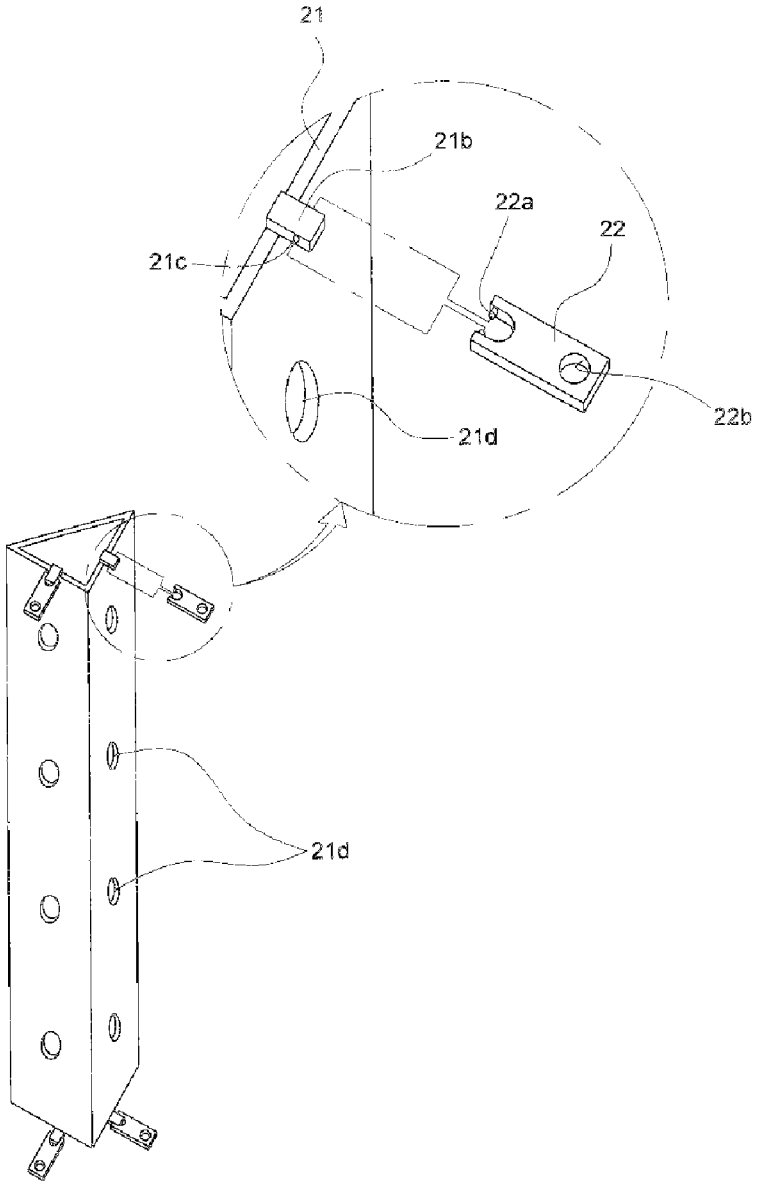
FIG. 4 is a detailed view showing the pressing member of the permanent rod according to one embodiment of the present invention.

FIG. 1 is an assembled perspective view showing a permanent rod according to one embodiment of the present invention, FIG. 2 is an exploded perspective view showing the permanent rod according to one embodiment of the present invention, FIG. 3 is a detailed view showing the rod body part of the permanent rod according to one embodiment of the present invention, and FIG. 4 is a detailed view showing the pressing member of the permanent rod according to one embodiment of the present invention.

As shown in these drawings, the permanent rod according to one embodiment of the present invention includes a tubular rod body 11 having a square cross-section and four pressing members 20 which are coupled with the rod body part 11.

The rod body part 11 has a pair of cut surfaces 11*b* which extend along the entire length of the rod body part 11 so as to form a band-shaped insertion opening 11*a*.

The pair of cut surfaces 11*b* has a concave-convex shape such that the cut surfaces 11*b* can engage with each other when they are adjoined to each other. The concave-convex shape of the cut surfaces 11*b* may include a variety of shapes, such as a saw-tooth shape and a wave shape.

In addition, the rod body part 11 has four pressing recesses 11*c* and a plurality of ring-seating grooves 11*e* on the outer surface and fixing protrusions 11*f* on the inner surface.

The pressing recesses 11*c* are formed on the side surfaces of the rod body part 11 such that one pressing recess is formed on one side surface. Each of the pressing recesses 11*c* extends along the length of the rod body part 11 so as to form a V-shaped recess bottom surface 11*d*.

Each of the ring-seating grooves 11*e* has a concave shape that extends in the longitudinal direction.

The fixing protrusions 11*f* are formed in the pressing recesses 11*c* such that a pair of the fixing protrusions 11*f* is formed adjacent to either end of each of the pressing recesses 11*c*.

Each of the pressing members 20 has a tubular pressing member body part 21 having a triangular cross-section and fixing levers 22 each of which is coupled to either end of the pressing member body part 21.

Two surfaces from among three side surfaces of the pressing member body part 21 form pressing surfaces 21*a* each of which has a V-shaped cross-section corresponding to the recess bottom surface 11*d*.

The pressing member body part 21 has support protrusions 21*b* each of which is provided on either end of each of the pressing surfaces 21*a*. The pressing member body part 21 has injection-holes 21*d* in the area that adjoins to the recess bottom surface 11*d*.

Each of the support protrusions 21*b* has a shaft-hole 21*c*.

Each of the fixing levers 22 has a pivot shaft 22*a* at one end and a fixing-hole 22*b* in an area that is adjacent to the other end.

Each of the fixing levers 22 is disposed such that the pivot shaft 22*a* is fitted into the shaft-hole 21*c*.

Each of the pressing members 20 having this configuration is coupled to the rod body part 11 in such a fashion that the fixing protrusion 11*f* is interference-fitted into the fixing-hole 22*b* in the state in which the pressing surfaces 21*a* are adjoined to the recess bottom surface 11*d*. The pressing members 20 coupled to the rod body part 11 can be separated from the rod body part 11 through removal of the fixing protrusions 11*f* from the fixing holes 22*b*.

Figure 5:
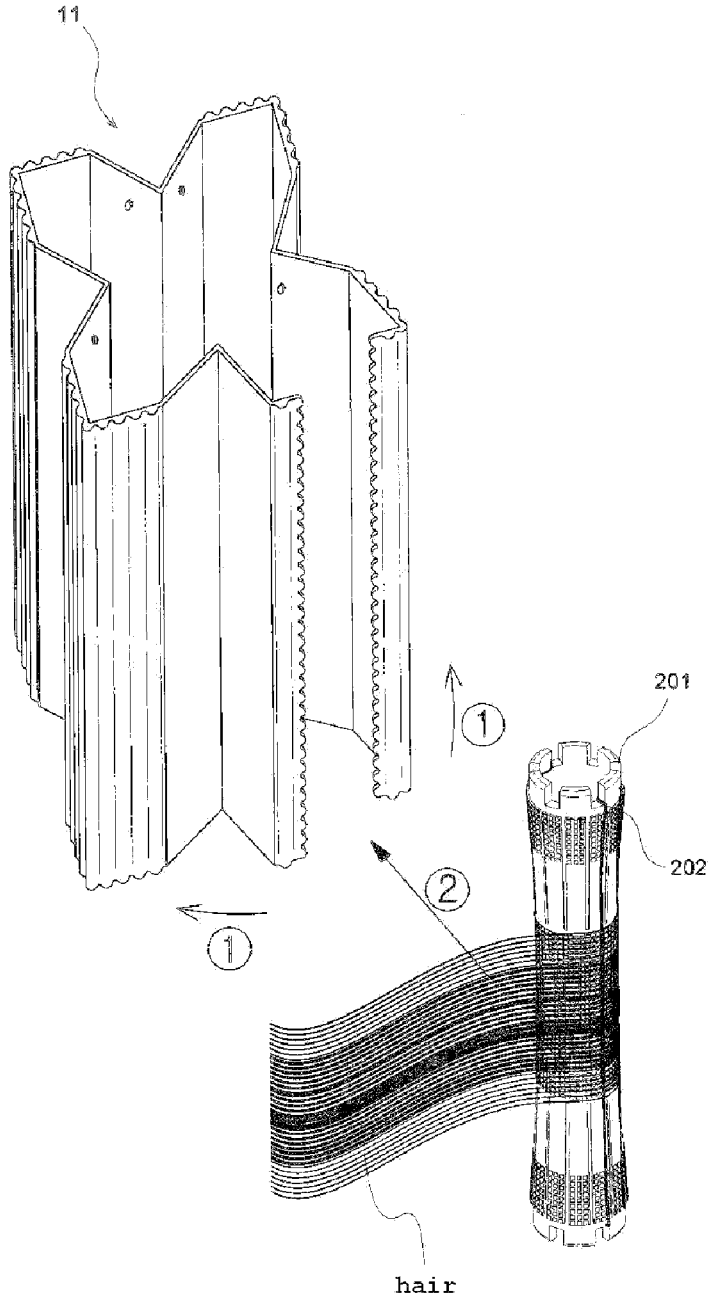
FIG. 5, FIG. 6 and FIG. 7 are views showing a method of using the permanent rod according to one embodiment of the present invention.
Figure 6:
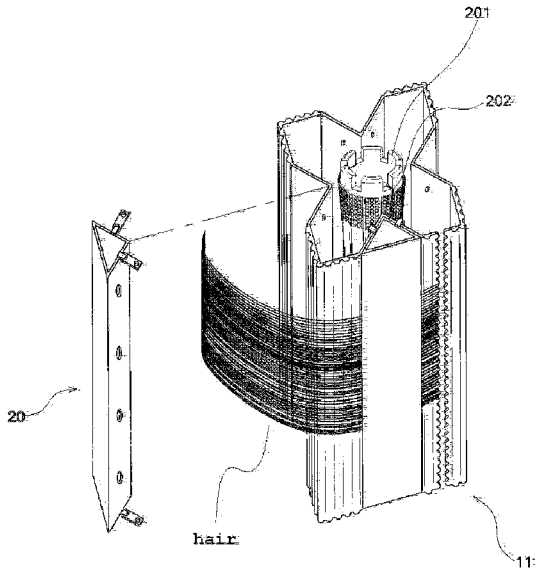
Figure 7:
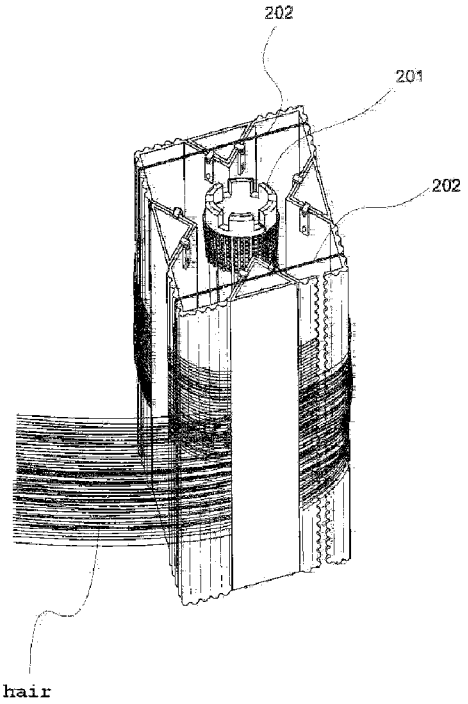

With reference to FIG. 5 to FIG. 7, a description will be given below of a method of using the permanent rod having the above-described configuration according to one embodiment of the present invention.

First, the distal portion of the hair is wound around an auxiliary rod 201 the diameter of which is smaller than the diameter of the rod body part 11, and the hair is held to the auxiliary rod 201 using a rubber ring 202 (see FIG. 5).

Afterwards, the auxiliary rod 201 on which the hair is wound is inserted into the rod body part 11 through the insertion opening 11*a*.

After that, the remaining portion of the hair is wound on the rod body part 11 (see FIG. 6).

The pressing members 20 are sequentially coupled to the rod body part 11 so as to come into close contact with the recess bottom surfaces 11*d* whenever the hair passes over the pressing recesses 11*c* while the hair is being wound on the rod body part 11 (see FIG. 7).

When it is intended to wind the hair on the rod body part 11 at least once, the pressing members 20 coupled to the rod body part 11 are sequentially separated from the rod body part 11, and then are coupled again to the rod body part 11.

Afterwards, the rubber ring 202 is coupled to the rod body part 11 so as to be accommodated in the ring-seating grooves 11*e*.

After that, when about 30 to 40 minutes have elapsed after the hair was wound on the rod body part 11, neutralizer is injected through injection-holes 21*d*.

Afterwards, when about 10 to 20 minutes have elapsed after the neutralizer was injected, the pressing member 20 is separated from the rod body part 11.

After that, the rubber ring 202 is separated from the rod body part 11.

Afterwards, all of the pressing members 20 are separated from the rod body part 11.

In sequence, the hair is unwound from the rod body part 11.

Afterwards, the auxiliary rod 201 is separated from the rod body part 11.

After that, the rubber ring 202 is separated from the auxiliary rod 201.

Finally, the hair is washed.

Although the auxiliary rod 201 is inserted into the rod body part 11 in the above-described method of using the permanent rod, it is possible to use the permanent rod according to one embodiment of the present invention by omitting the step of inserting the auxiliary rod 201 into the rod body part 11.

Mode For Invention

Figure 8:
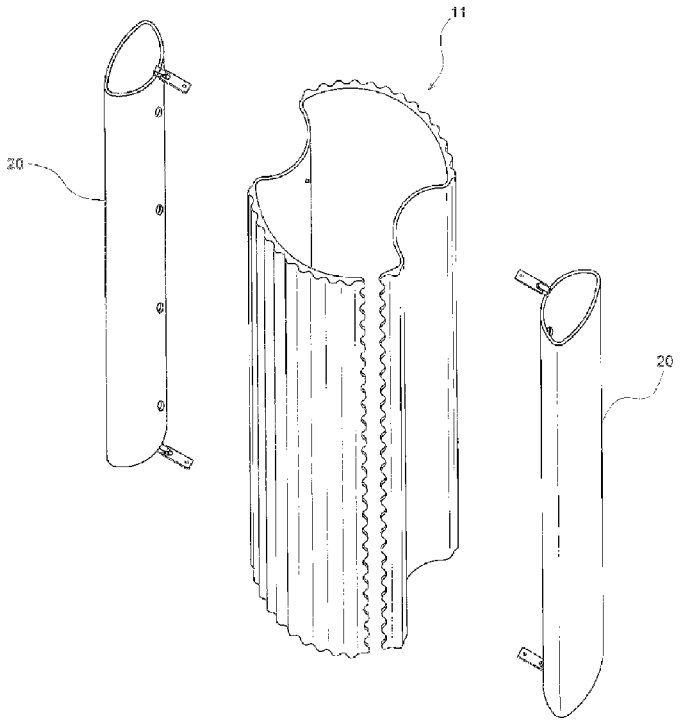
FIG. 8 is an exploded perspective view showing the permanent rod according to another embodiment of the present invention.
Figure 9:
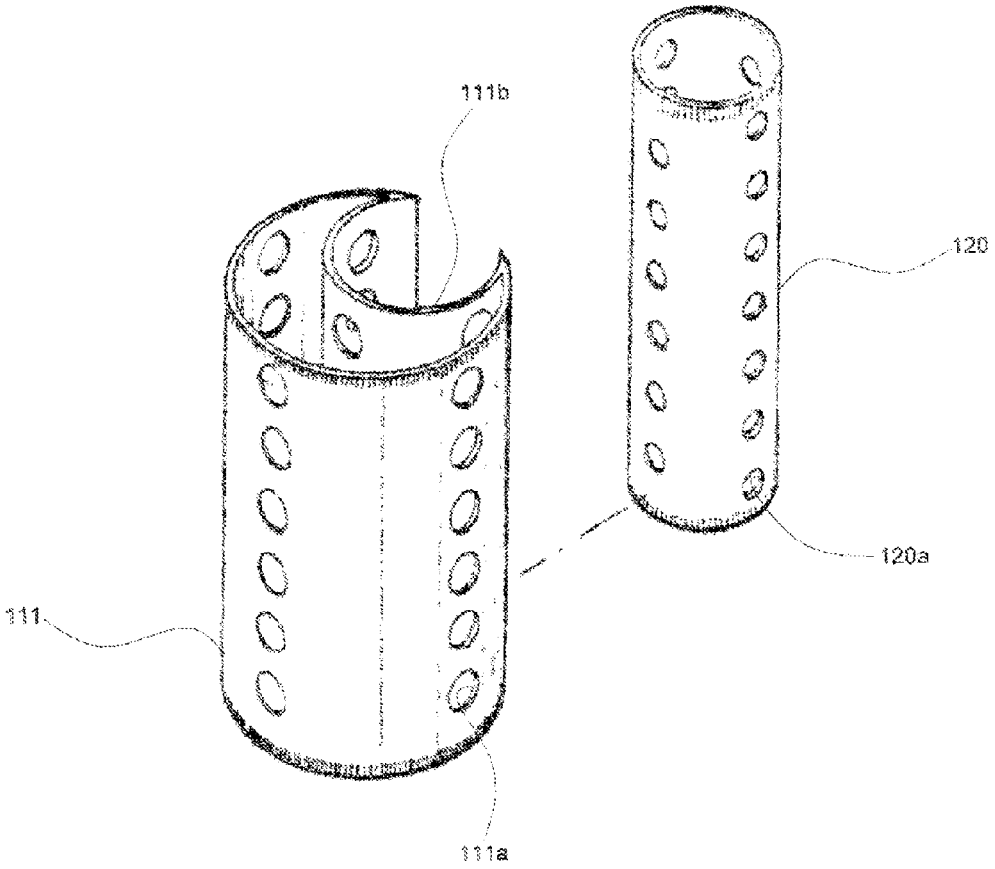
FIG. 9 (Prior Art)
FIG. 9 is an exploded perspective view of a permanent rod of the related art.
Figure 10:
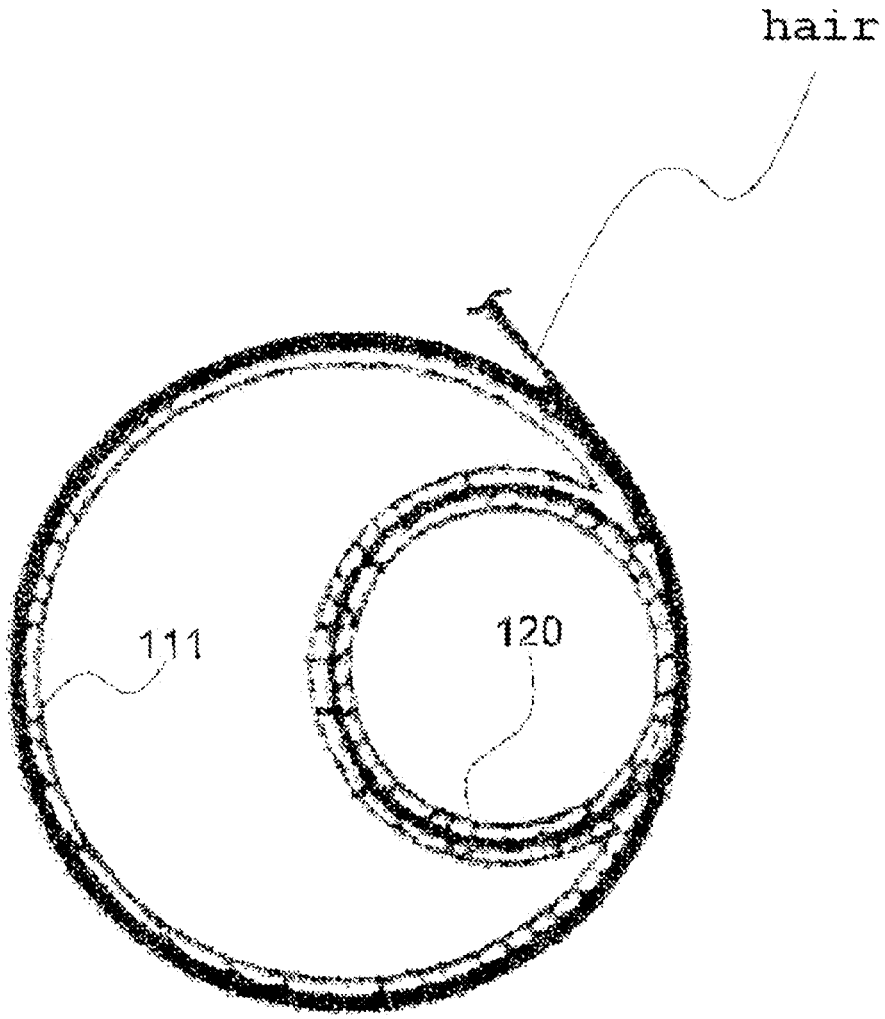
FIG. 10 (Prior Art)
FIG. 10 is a view showing a method of using the permanent rod of the related art.

Although the foregoing embodiment has the four pressing recesses 11*c* in the rod body part 11, it is possible to put the present invention into practice by forming 1, 2, 3, 4 or more pressing recesses (see FIG. 8).

In addition, although the rod body part 11 is configured so as to have a square or circular cross-section in the foregoing embodiment, it is possible to put the present invention into practice by forming the rod body part 11 into a different shape such as a pentagonal cross-sectional shape.

Industrial Applicability

According to the embodiments of the present invention as set forth above, it is possible to make various waves by forming waves using the pressing recesses 11*c* formed on the rod body part 11 and the pressing members 20 which are coupled to the rod body part 11 so as to be in close contact with the pressing recesses 11*c*.

In addition, since the pair of cut surfaces 11*b* has the concave-convex shape such that the cut surfaces lib can engage with each other when they are adjoined to each other, it is possible to prevent the rod body part 11 from being warped when the hair is being wound on the rod body part 11.

Furthermore, since the pressing recesses 11*c* are formed so as to have the V-shaped recess bottom surfaces 11*d*, it is possible to reduce the movement of the hair that is brought into close contact with the pressing recesses 11*c* by the pressing members 20.

In addition, since the ring-seating grooves 11*e* are formed on the outer surface of the rod body part 11 in the longitudinal direction, it is possible to use the permanent rod according to the present invention by omitting the step of inserting the auxiliary rod 201 into the rod body part 11.

Furthermore, since the injection-holes 21*d* are formed in the areas that adjoin to the recess bottom surfaces 11*d* of the pressing members 20, it is possible to reliably maintain waves formed by the pressing members 20.

The invention claimed is:

1. A permanent rod comprising:

a tubular rod body part, wherein the rod body part comprises a pair of cut surfaces which extend along an entire length of the rod body part so as to form a band-shaped insertion opening and a plurality of pressing recesses which extends along the entire length of the rod body part, each of the pressing recesses having a concave recess bottom surface; and pressing members, wherein each of the pressing members comprises a pressing member body part which has a pressing surface corresponding to the recess bottom surface, and the pressing members are detachably coupled to the rod body part such that the pressing surface adjoins to the recess bottom surface;

wherein the rod body part has fixing, protrusions on an inner surface;

wherein each of the pressing members has fixing levers each of which is coupled to either end of the pressing member body part;

wherein the pressing member body part has support protrusions each of which is provided on either end of each of the pressing surface;

wherein each of the support protrusions has a shaft-hole;

wherein each of the fixing levers has pivot shaft at one end and a fixing-hole in an are that is adjacent to another end; and wherein each of die fixing disposed such that the pivot shat is fitted into the shaft-hole.

2. The permanent rod according to claim 1, wherein the pair of cut surfaces has a concave-convex shape that allows the cut surfaces to engage with each other when the cut surfaces are adjoined to each other.

3. The permanent rod according to claim 2, wherein each of the pressing recesses is formed so as to have a V-shaped recess bottom surface.

4. The permanent rod according to claim 2, wherein the rod body part comprises a ring-seating groove on an outer surface, the ring-seating groove extending in a longitudinal direction of the rod body part.

5. The permanent rod according to claim 2, wherein each of the pressing members has a tubular shape, and each of the pressing members has injection-holes in an area that adjoins to the recess bottom surface.

6. The permanent rod according to claim 1, wherein each of the pressing recesses is formed so as to have a V-shaped recess bottom surface.

7. The permanent rod according to claim 1, wherein the rod body part comprises a ring-seating groove on an outer surface, the ring-seating groove extending in a longitudinal direction of the rod body part.

8. The permanent rod according to claim 1, wherein each of the pressing members has a tubular shape, and each of the pressing members has injection-holes in an area that adjoins to the recess bottom surface.

* * * * *